United States Patent [19]

Folkins et al.

[11] Patent Number: 4,492,179

[45] Date of Patent: Jan. 8, 1985

[54] CONTROL SYSTEM FOR REGULATING THE DISPENSING OF MARKING PARTICLES IN AN ELECTROPHOTOGRAPHIC PRINTING MACHINE

[75] Inventors: Jeffrey J. Folkins; Shahid Haque; Alfred M. Loeb; Henry R. Till, all of Rochester, N.Y.

[73] Assignee: Xerox Corporation, Stamford, Conn.

[21] Appl. No.: 505,014

[22] Filed: Jun. 16, 1983

[51] Int. Cl.[3] ..... G03G 13/00; G03G 15/06

[52] U.S. Cl. ..... 118/689; 118/690; 355/3 DD; 430/122

[58] Field of Search ..... 118/689, 690; 355/3 DD; 430/122

[56] References Cited

U.S. PATENT DOCUMENTS 3,719,165 3/1973 Trachienberg ..... 118/637

4,064,834 12/1977 Sund ..... 118/690

OTHER PUBLICATIONS

Research Disclosure #103, Nov. 1972, pp. 35–36.

*Primary Examiner*—John E. Kittle
*Assistant Examiner*—John L. Goodrow
*Attorney, Agent, or Firm*—H. Fleischer; J. E. Beck; R. Zibelli

[57] ABSTRACT

An apparatus which develops a latent image with marking particles. The apparatus includes a developer roller which transports the marking particles closely adjacent to the latent image. As the marking particles are deposited on the latent image, the developer roller senses the charge thereon. In response to the sensed charge of the marking particles, additional marking particles are dispensed into the chamber of the housing for subsequent use by the developer roller.

20 Claims, 3 Drawing Figures

Figure 1:
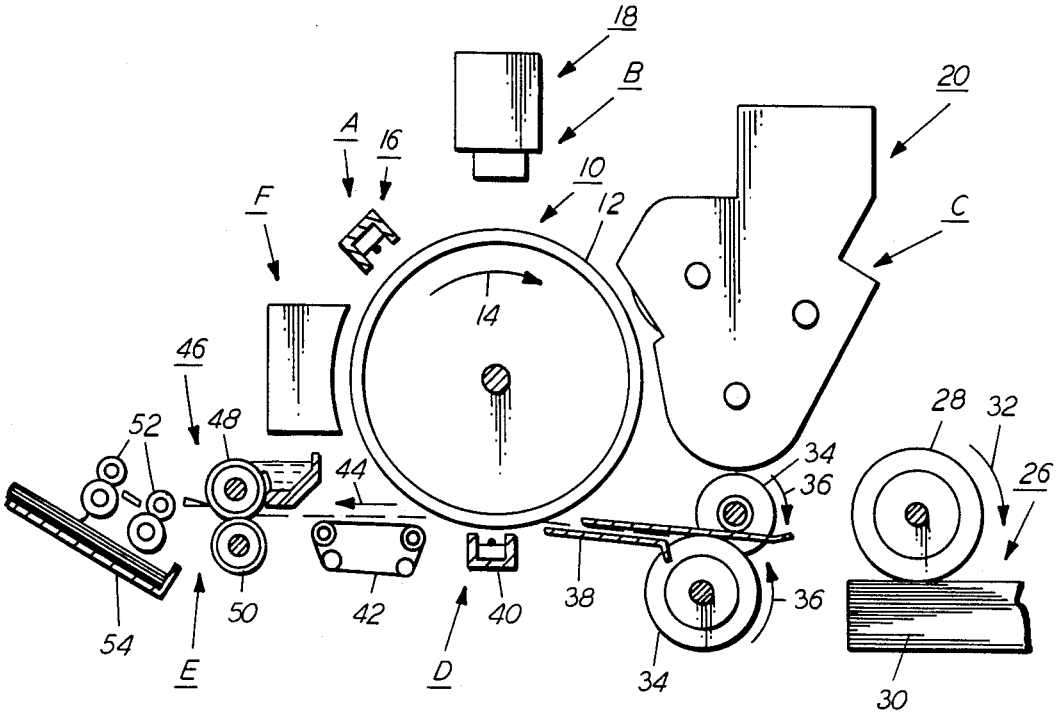

CONTROL SYSTEM FOR REGULATING THE DISPENSING OF MARKING PARTICLES IN AN ELECTROPHOTOGRAPHIC PRINTING MACHINE

This invention relates generally to an electrophotographic printing machine, and more particularly concerns a scheme for controlling the dispensing of toner particles into the developer mixture by determining the charge of the toner particles developing the latent image and discharging additional toner particles into the development system in response thereto.

In general, the process of electrophotographic printing includes charging a photoconductive member to a substantially uniform potential to sensitize the surface thereof. The charged portion of the photoconductive surface is exposed to light image of an original document being reproduced. Alternatively, a modulated light beam, i.e. a laser beam, may be utilized to discharge selected portions of the charged photoconductive surface to record the desired information thereon. In this way, an electrostatic latent image is recorded on the photoconductive surface which corresponds to the information desired to be reproduced. After recording the electrostatic latent image on the photoconductive member, the latent image is developed by bringing developer material into contact therewith. Generally, the developer material comprises toner particles adhering triboelectrically to carrier granules. The toner particles are attracted from the carrier granules to the latent image forming a toner powder image on the photoconductive member which is subsequently transferred to a copy sheet. Finally, the copy sheet is heated to permanently affix the powder image thereto in image configuration.

As toner particles are depleted from the developer material, additional toner particles must be added thereto. Different types of toner dispensing systems are known in the art. For example, U.S. Pat. No. 2,956,487 issued to Giaimo, Jr. in 1960 discloses a photocell which detects light rays reflected from a developed image. The signal from the photocell is then suitably processed to form a control signal. This control signal regulates the dispensing of toner particles into a developer mixture. U.S. Pat. Nos. 3,348,522 and 3,348,523 issued to Donohue and Davidson et al. in 1967 both describe a device which exposes a strip along the edge of the charged photoconductive drum. The stripe is developed with toner particles. A fiber bundle directs light rays onto the developed stripe and the bare surface of the photoconductive drum. One photocell detects the ligh rays reflected from the developed stripe. Another photocell detects the light rays reflected from the bare photoconductive surface. The photocells form two legs of a bridge circuit used to control toner dipsensing. U.S. Pat. No. 3,553,464 issued to Abe in 1971 describes a charged tape which is developed with toner particles. The tape passes between a light source and a photoelectric converter. The intensity of the light rays detected by the photoelectric converter, as indicated by a meter, corresponds to the density of the toner particles developed on the tape. If the tape is impervious to light, light rays may be reflected from the tape rather than being transmitted therethrough. U.S. Pat. No. 3,754,821 issued to Whited in 1973 discloses an electrically biased transparent plate secured to a photoconductive drum which is developed with toner particles. A light source directs light rays through the plate onto a photocell. The electrical output signal from the photocell is processed and an error signal generated for energizing a toner dispenser which furnishes additional toner particles to a developer mixture. U.S. Pat. No. 4,318,651 issued to Grace in 1982 describes an infrared densitometer positioned closely adjacent to a photoconductive surface. The infrared densitometer detects the density of toner particles adhering to a pair of test areas recorded on the photoconductive surface. The output signal resulting from the density of toner particles deposited on one of the test areas is used to regulate the charging of the photoconductive surface with the signal corresponding to the density of the toner particles adhering to the other test area being employed to control dispensing of toner particles into the developer mixture. Thus, it is clear that numerous schemes have been devised for controlling the dispensing of toner particles into the developer material as the toner particles are depleted therefrom. The following disclosure appears to be relevant:

U.S. Pat. No. 3,719,165

Patentee: Trachtenberg et al.

Issued: Mar. 6, 1973

The pertinent portion of the foregong disclosure may be briefly summarized as follows:

Trachtenberg et al. discloses a magnetic brush development station in which the toner particle concentration of the developer material is monitored by sampling the self biasing potential generated by the magnetic brush as it periodically contacts the uncharged areas of the photoconductive surface. The toner particles are dispensed into the development system inversely proportional to the potential detected by the magnetic brush.

In accordance with one aspect of the features of the present invention, there is provided an apparatus for developing a latent image with marking particles. The apparatus includes means for storing a supply of marking particles. Means dispense marking particles into the storing means. Means transport the marking particles from the storing means to a location closely adjacent to the latent image. The transporting means senses the charge of the marking particles being deposited on the latent image and transmits a signal indicative thereof to the dispensing means. The dispensing means regulates the discharging of marking particles into the storing means in response to the received signal.

Pursuant to another aspect of the features of the present invention, there is provided an electrophotographic printing machine of the type having an electrostatic latent image recorded on a photoconductive surface. Developer material comprising at least carrier granules having toner particles adhering triboelectrically thereto is advanced closely adjacent to the latent image so that the toner particles are attracted from the carrier granules to the latent image forming a toner powder image on the photoconductive surface. Means are provided for storing a supply of developer material. Means dispense toner particles into the storing means. Means transport the developer material from the storing means to a location closely adjacent the latent image. The transporting means senses the charge of the toner particles being deposited on the latent image and transmits a signal indicative thereof to the dispensing means for regulating the discharge of the toner particles into the storing means.

In accordance with still another aspect to the present invention, there is provided a method of developing a latent image with marking particles. The method includes the steps of storing a supply of marking particles in a housing. The marking particles in the housing are transported on a developer roller to a location closely adjacent to the latent image so that the marking particles are attracted thereto. The charge of the marking particles attracted to the latent image is sensed. In response to the sensed charge, marking particles are dispensed into the housing.

Pursuant to still another aspect to the features of the present invention, there is provided a method of developing an electrostatic latent image recorded on a photoconductive surface with developer material comprising at least carrier granules having toner particles adhering triboelectrically thereto. The method includes the steps of storing a supply of developer material in a housing. The developer material is transported on a developer roller to a location closely adjacent to the latent image so that toner particles are attracted thereto. The charge of the toner particles attracted to the latent image is sensed. In response to the sensed charge, additional toner particles are dispensed into the housing.

Figure 3:
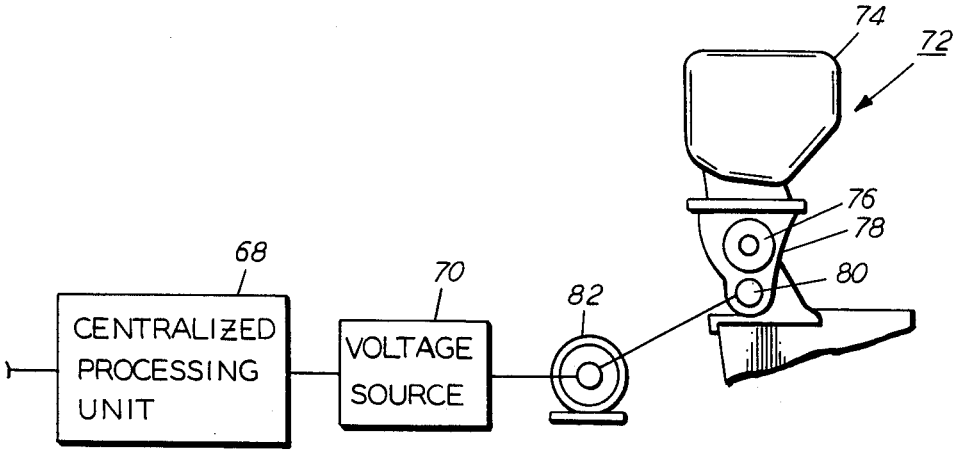
Figure 2:
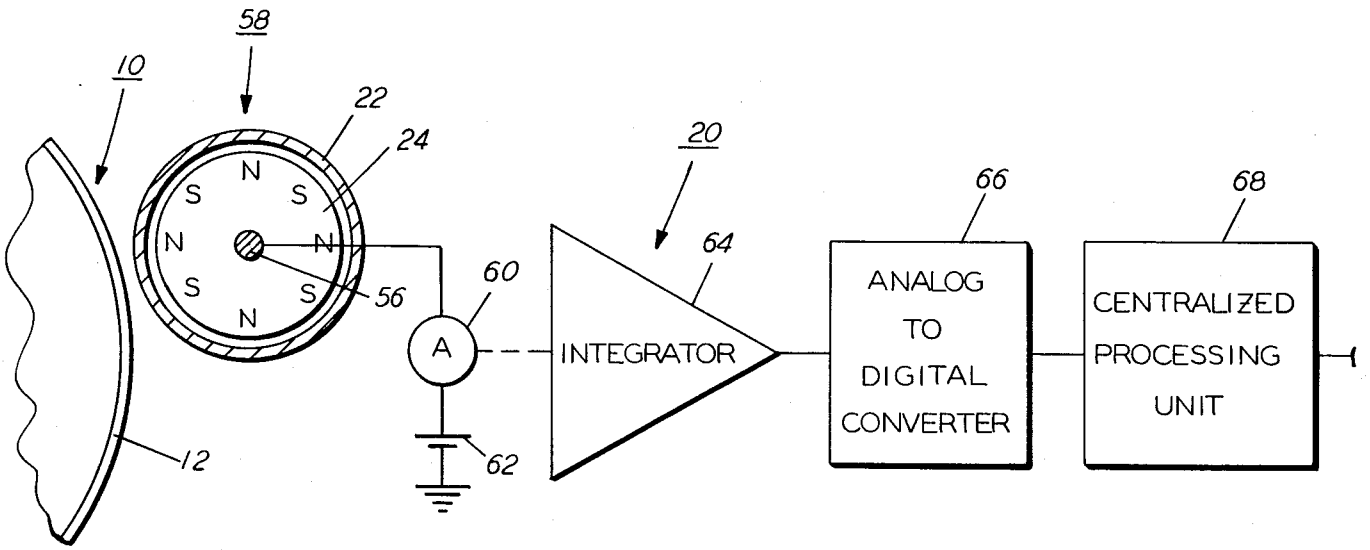

Other aspects of the present invention will become apparent as the following description proceeds and upon reference to the drawings, in which:

FIG. 1 is a schematic elevational view showing an illustrative electrophotographic printing machine incorporating the features of the present invention therein;

FIG. 2 is a schematic diagram illustrating the control scheme employed in the FIG. 1 printing machine; and FIG. 3 is a schematic diagram depicting the regulation of the dispensing of toner particles in the FIG. 1 printing machine. de While the present invention will hereinafter be described in conjunction with a preferred embodiment thereof, it will be understood that it is not intended to limit the invention to that embodiment. On the contrary, it is intended to cover all alternatives, modifications and equivalents as may be included in the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the apparatus of the present invention therein. It will become evident from the following discussion that this apparatus is equally well suited for use in a wide variety of electrostatograhic printing machines and is not necessarily limited to its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. Preferably, the photoconductive surface 12 comprises a charge generator layer having photoconductive particles dispersed randomly in an electrically insulating organic resin. The conductive substrate comprises a charge transport layer having a transparent, electrically inactive polycarbonate resin with one or more diamines dissolved therein. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. In imaging system 18, an original document is positioned facedown upon a transparent platen. Lamps illuminate the original document with the light rays reflected therefrom being transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. After the electrostatic latent image has been recorded on photoconductive surface 12, drum 10 advances the latent image in the direction of arrow 14 to development station C.

At development station C, a magnetic brush development system, indicated generally by the reference numeral 20, transports a developer mixture of carrier granules having toner particles adhering triboelectrically thereto into contact with the electrostatic latent image. The latent image attracts the toner particles from the carrier granules forming a toner powder image on photoconductive surface 12. As successive electrostatic latent images are developed, toner particles are depleted from the developer mixture. A toner particle dispenser disposed in development system 20 is arranged to furnish additional toner particles to the developer mixture for subsequent use thereby. The detailed structure of the development system and the manner in which toner particle dispensing is controlled will be described hereinafter with references to FIGS. 2 and 3.

After development, drum 10 advances the powder image to transfer station D. At transfer station D, a sheet of support material is moved into contact with the powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet of support material into contact with the photoconductive surface 12 of drum 10 in a timed sequence so that the powder image developed thereon contacts the advancing sheet at transfer station D.

Preferably, transfer station D includes a corona generating device 40 which sprays ions onto the backside of the sheet. This attracts the powder image from the photoconductive surface to the sheet. After transfer, the sheet continues to move in the direction of arrow 42 onto a conveyor 44 which advances the sheet to fusing station E.

Fusing station E includes a fuser assembly, indicated generally by the reference numeral 46, which permanently affixes the transferred powder image to the sheet. Preferably, the fuser assembly 46 includes a heated fuser roller 48 and a back-up roller 50. The sheet passes between fuser roller 48 and back-up roller 50 with the powder image contacting fuser roller 48. In this manner, the powder image is permanently affixed to the sheet. After fusing, forwarding rollers 52 advance the sheet to catch tray 54 for subsequent removal from the printing machine by the operator.

After the powder image is transferred from photoconductive surface 12 to the copy sheet, drum 10 rotates the photoconductive surface to cleaning station F. At cleaning station F, a cleaning brush removes the residual particles adhering to photoconductive surface 12.

It is believed that the foregoing description is sufficient for purposes of the present invention to illustrate the general operation of an electrophotographic printing machine incoporating the features of the present invention therein.

Referring now to the specific subject matter of the present invention, FIG. 2 depicts the development system used in the FIG. 1 printing machine in greater detail. As illustrated thereat, development system 20 includes a developer roller, indicated generally by the reference numeral 58, comprising a non-magnetic tubular member 22 mounted rotatably on an electrically conductive shaft 56. Preferably, tubular member 22 is made from aluminum having the exterior circumferential surface thereof roughened with shaft 56 being made from stainless steel. An elongated magnet 24 is mounted stationarily on shaft 56 and disposed interiorly of and spaced from tubular member 22. By way of example, magenet 24 is made from barium ferrite having a plurality of magnetic poles impressed about the circumferential surface thereof. A current sensor, indicated generally by the reference numeral 60, is coupled to shaft 56. Current sensor 60 is coupled to a voltage source 62 which electrically biases shaft 56 and, in turn, tubular member 22 through its conductive bearings. Current sensor 60 may make the current measurement by sensing the voltage drop across a resistor in series with voltage source 62. The output from current sensor 60 is transmitted to an integrator 64. Integrator 64 may be an operational amplifier which integrates the current signal transmitted from current senor 60 over a desired interval of time. The output signal from integrator 64 is transmitted to an analog to digital converter 66. In turn, the output from analog to digital converter 66 is transmitted to centralized processing unit 68 within the electrophotographic printing machine. It should be noted that analog to digital converter 66 may be an integral portion of centralized processing unit 68. Centralized processing unit 68 comprises logic circuitry which, in turn, develops an error signal for controlling the dispensing of toner particles into the housing of the developer system. In this way, toner particles are dispensed into the development system as a function of the developed charge. This is due to the fact that the developed charge may be measured by the bias current. One skilled in the art will appreciate that the same process may be accomplished with an analog voltage to time converter replacing the centralized processing unit and the analog to digital converter.

Turning now to FIG. 3, there is shown the manner in which centralized processing unit 68 regulates the dispensing of toner particles into the developer housing. As shown thereat, centralized processing unit 68 transmits an error signal to voltage source 70. The error signal from centralized processing unit 68 regulates the output voltage from voltage source 70 so as to control the furnishing of additional toner particles to the development system. The toner dispenser, indicated generally by the reference numeral 72, is disposed in development station 20. Toner dispenser 72 includes a container 74 storing a supply of toner particles therein. A suitable roller 76 is disposed in chamber 78 coupled to container 74 for dispensing toner particles into auger 80. By way of example, auger 80 comprises a helical spring mounted in a tube having a plurality of apertures therein. Motor 82 rotates the helical member of auger 80 so as to advance the toner particles through the tube. The toner particles are then dispensed from the apertures thereof into the chamber of the development system housing for use by developer roller 58. Energization of motor 82 is controlled by voltage source 70. Voltage source 70 is connected to centralized processing unit 68. The measured charge of the developed mass of toner particles on the photoconductive surface is proportional to the current measurement. The current measurement is integrated and compared to a deired value and an error signal developed for controlling the addition of toner particles to the development system. This error signal is utilized to control voltage source 70 which, in turn, energizes motor 82. In this way, additional toner particles are furnished to the development system as a function of the charge of the developed toner particles on the photoconductive surface.

One skilled in the art will appreciate that a sample electrostatic latent image may be recorded on photoconductive surface 12 by illuminating a patch of charged area, preferably in the interimage region. This sample electrostatic latent image may now be developed by developer roller 58 with the charge of the toner particles deposited thereon being monitored as heretofore described for developing the latent image. This technique may be utilized in lieu of measuring the charge of toner particles being deposited on the latent image.

The toner dispenser system discharges toner particles proportionally to the bias current during development. This scheme maintains the developed toner particle tribocharge at a constant adjustable rate over time independent of developer material triboproduct changes. It is the developed toner particle tribocharge rather than the developer material sump tribocharge which is controlled. This advantageous in systems where the ratio of developed to sump tribo changes with time. The system also has the advantage of being a feedforward toner concentration controller. After each image is developed, the appropriate toner particle mass is dispensed to the sump of the developer housing to maintain the toner concentration constant.

In steady state, the toner particle mass going into the sump equals the mass going out. If the ratio of the toner particle charge current to mass dispense rate, (charge rate)/mass rate), is kept constant, the charge to mass ratio (tribo) of the toner particles leaving and entering the sump is constant. The sump will eventually reach a point where the developed tribo value detemined by the charge to dispense rate is constant.

A mathematical model which theoretically describes the behavior of the developer material with the proposed toner particle dispense system may be derived readily. The following terms are defined as:

$m_T$=toner mass in sump
$m_C$=carrier mass in sump
$m_{PR}$=development rate of toner on P/R
$m_d$=dispense rate of toner dispenser
$m_{Err}$=error in toner dispense rate
$I_B$=bias current
$I_{PR}$=current of developed toner charge on P/R
$I_{Err}=I_B-I_{PR}$=error current
Tr=tribocharge of developed toner (charge/mass)
TC=toner concentration ($m_T/m_C$)
K=proportionally factor of dispense rate to bias current For the ideal case, the following assumptions are made:

$$I_B=I_{PR} \quad (1)$$

The measured bias current is equal to the developed toner particle current. There must be no other current leakage paths.

$$m_{PR}=I_{PR}/Tr \quad (2)$$

The developer toner particle mass is related to the developed toner particle charge through the tribo Tr, i.e. the tribo is a well defined quantity. Excessive wrong sign toner developed interferes with this assumption.

$$Tr = \frac{A}{C_O + TC}$$

This is the standard tribo to toner concentration relation and is not necessary to obtain the negative feedback features. It is only necessary that the tribo be a monotonic decreasing function of TC.

$$m_T=m_d-m_{PR} \quad (4)$$

The toner particle mass equals mass developed, i.e. if ther is not excessive toner leakage from the housing.

An ideal toner concentration (TC) controller is constructed by dispensing toner particles with the bias current and according to the proportionality constant K.

This is equivalent to writing:

$$m_d=KI_B \quad (5)$$

This requires a change in the dispensing rate as a function of the instantaneous measured bias current. However, it is equivalent (and much more practical) to integrate the current over some fixed period of time (e.g. a copy) and dispense an amount of toner particles afterward depending upon this integration.

The toner concentration (TC) can be determined from the four assumptions of Eqs. 1–4 and the imposed condition of Eq. 5. Combining Eqs. 1, 2, 4 and 5 gives:

$$m_T=I_B(K-1/Tr) \quad (6)$$

With Eq. 3 this becomes $$m_T+m_T(I_B/mCA)+I_BC_O/A-I_BK=0 \quad (7)$$

This has the time dependent solution with the initial condition $m_T(t=O)$, $$m_T(t)=m_CAK-m_CCO+(m_T(O)-m_CAK+m_CC_0)e^{-I_Bt/m_CA} \quad (8)$$

or with an initial tribo condition Tr (t=O), $$Tr(t)=\{K+(1/Tr(O)-K)_e-I_Bt/m_CA\}-1 \quad (9)$$

Eq. 9 states that if the sump starts out developing toner particles with an intial tribo Tr(O), the tribo wll exponentially approach the limiting value of the set parameter 1/K with a time constant of $Am_C/I_B$ ($I_Bt$ is the net developed charge in time t).

The developed tribo of the toner particles will approach the value 1/K after a sufficient time (in steady state). This value K is the current/dispense rate or (charge/time)/(mass/time)=charge/mass=tribochare. Eq. 9 verifies the assertion that the dispense control condition of Eq. 5 is a stable negative feedback (closed loop) system and that the desired tribo value will be held even if the system is disturbed.

The time constant $Am_C/I_B$ of Eq. 9 can be compared with the natural time constant for detoning a developer material when no additional toner particles are added. The change in tribo when toner particles are depleted from the sump with no toner particles being dispensed yields $$Tr = \left[1 + \frac{I_Bt}{m_CA}\right] Tr(O) \quad (10)$$

Eq. 10 shows that the same time constant which naturally controls the tribo also controls the particle dispense feedback system. When no toner particles are added (as described by Eq. 10), the system is most rapidly toned down. Thus, no other developability toner particle control system can have a time constant significantly better than that of the proposed system. Hence, the time response of Eq. 9 is satisfactory.

An error in the measurement of the charge current or in the dispense rate will effect the controlled tribo, e.g. if there is a net toner flow into or out of the sump not considered in the initial assemption Eq. 4. This error is $m_{Err}$. Eq. 4 can be rewritten as:

$$m_T=m_d-m_{PR}+m_{Err} \quad (11)$$

This $m_{Err}$ could derive from a faulty toner dispenser, toner lost through powder clouding and dirt or development of low/wrong sign toner. Similarly, if the measured bias current $I_B$ is not exactly the developed toner charge $I_{PR}$, the assumption of Eq. 1 must be modified by an error current $I_{Err}$ as:

$$I_B=I_{PR}+I_{Err} \quad (12)$$

The error current, $I_{Err}$, could come from electrical leakage paths from the developer housing or from magnetic brush charge exchange with the photoconductive surface.

Solving Eqs. 2, 3, 5, 11 and 12 gives a final result of:

$$Tr(t) = \{K' + (1/Tr(O) - K')e^{-I_Bt/mCA}\}^{-1} \quad (13)$$

with $$K' = (K) + (K)\left(\frac{I_{Err}}{I_{PR}}\right) + \left(\frac{\dot{m}_{Err}}{I_{PR}}\right)$$

From Eq. 13 we see that the effect of introducing the error terms $I_{Err}$ and $m_{Err}$ is to shift the steady state tribo from 1/K to 1/K', with the time response functional form remaining the same as in Eq. 9. The new tribo 1/K' remains close to 1/K if the error terms are small according to $I_{Err}/I_{PR} << 1$ and $m_{Err}/I_{PR} << 1$. If these conditions are not satisfied, the controlled tribo will not be stable since the error terms, and hence F', vary with time. $I_{Err}$ and $m_{Err}$ will not vary according to $I_{PR}$, i.e. the area coverage, and will change for each copy. If the terms $I_{Err}$ and $m_{Err}$ are constant, they may be easily compensated for.

It is clear that there are various assumptions and contraints necessary for the dispense system to work properly. The results are based on the validity of Eqs. 1-5. Turning now to each of these equations.

Eq.1, the bias current measurement, assumes that the tomer charge current and bias current are related. Current leakage paths out of the housing will give problems. Leakage paths ($>10^{-7}$ Amps) are mainly a problem in hot/humid conditions. Some photoreceptors have significant charge exchange between the magnetic brush tips and the photoconductive surface. This is a serious difficulty which must be dealt with. One remedy for these problems is to make in situ "zero" measurements. That is, make a bias current measurement in a background (non-developed) region of an interdocument area and use the value to offset subsequent current measurements. For example, it could be assumed that there will always be a white area on each copy and the minimum current measured with each copy could be used as the offset current.

Eq. 2, the tribocharge relation, assumes that the developed charge is related to the mass in a constant manner. In practice, developer materials do not have sharply peaked charge distributions as Eq. 2 assumes. This is not a problem as long as the shape of the distribution of developed charge does not significantly change for different development potentials. For example, development of wrong/low sign toner preferentially in background areas will create a problem because the average tribo in Eq. 2 will then depend on input image characteritics which vary from copy to copy.

Eq. 3, the Tc-tribo relation, is an arbitrary assumption. This standard form was chosen only for convenience. When A is small the system time response is improved. But this occurs at the expense of increasing the tribo dependence on toner concentration (TC). The necessary constraint is that the tribo must be a monotonic decreasing function of toner concentration (TC). An "increasing" function would create an unstable positive feedback loop system. Nearly all developer materials have the proper decreasing monotonic behavior.

Eq. 4, toner mass conservation, will be violated only if toner particles are lost from the developer housing other than through development.

Eq. 5, the dispense control equation, requires that the toner particle mass be dispensed according to the bias current, typical bias currents will vary between 0.1 and 10 $\mu$A. Accurate measurements of this current do not present difficulties, particularly since the currents will be integrated and much of the noise filtered out. It is important to also consider the toner particle dispenser. The rate of dispense must remain constant over life. Any variation in mass dispensed for a given electrical input will manifest itself proportionally as a controlled tribo shift (shift in K).

In recapitulation, it is evident that the system of the present invention controls the dispensing of toner particles into the developer housing of the development system as a function of the charge of the toner particles developed on the electrostatic latent image. The charge, as measured by the bias current, is sensed by the developer roller. An electrical output signal proportional thereto is integrated and converted to a digital signal which, in turn, is processed by the centralized processing unit of the electrophotographic printing machine. The error signal transmitted from the centralized processing unit controls the discharge of toner particles into the housing of the development system.

While the present invention has been described as being used with an optical system employed to scan an original document, one skilled in the art will appreciate that such a system may also be utilized with a modulated laser beam arranged to irradiate selected areas of the charged portion of the photoconductive surface to record the electrostatic latent image on the photoconductive surface in this latter manner.

It is, therefore, apparent that there has been provided in accordance with the present invention, an apparatus for regulating the dispensing of toner particles into a development system as a function of the charge of toner particles developed on the electrostatic latent image. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to cover all such alternatives, modifications and variations as fall within the spirit and broad scope of the appended claims.

What is claimed is:

1. An apparatus for developing a latent image with marking particles, including:

means for storing a supply of marking particles;

means for dispensing marking particles into said storing means; and means for transporting the marking particles from said storing means to a location closely adjacent the latent image, said transporting means sensing the charge of the marking particles developed on the latent image and transmitting a signal indicative thereof to said dispensing means for regulating the discharging of marking particles into said storing means.

2. An apparatus according to claim 1, wherein said transporting means includes:

a developer roll; and means for electrically biasing said developer roll.

3. An apparatus according to claim 2, wherein said transporting means includes means for detecting the current biasing said developer roll and transmitting a signal indicative thereof.

4. An apparatus according to claim 3, wherein said transporting means includes means, in communication with said detecting means, for integrating the signal received from said detecting means.

5. An apparatus according to claim 4, wherein said transporting means includes logic circuitry, in communication with said integrating means, for processing the signal received from said integrating means and transmitting a control signal to said dispensing means for regulating the discharge of marking particles therefrom into said storing means.

6. An apparatus according to claim 5, wherein said developer roll includes:

a tubular member mounted rotatably for transporting the marking particles closely adjacent to the latent image; and an elongated magnetic member disposed interiorly of and spaced from said tubular member to attract the marking particles thereto.

7. An apparatus according to claim 6, wherein said electrical biasing means includes a voltage source coupled to said tubular member.

8. An electrophotograhic printing machine of the type having an electrostatic latent image recorded on a photoconductive surface with a developer material comprising at least carrier granules having toner particles adhering triboelectrically thereto being advanced closely adjacent to the latent image so that the toner particles are attracted from the carrier granules to the latent image forming a toner powder image on the photoconductive surface, wherein the improvement includes:

means for storing a supply of developer material;

means for dispensing toner particles into said storing means; and means for transporting the developer material from said storing means to a location closely adjacent the latent image, said transporting means sensing the charge of the toner particles developed on the latent image and transmitting a signal indicative thereof to said dispensing means for regulating the discharge of the toner particles into said storing means.

9. A printing machine according to claim 8, wherein said transporting means includes:

a developer roll; and means for electrically biasing said developer roll.

10. A printing machine according to claim 9, wherein said transporting means includes means for detecting the current biasing said developer roll and transmitting a signal indicative thereof.

11. A printing machine according to claim 10, wherein said transporting means includes means, in communication with said detecting means, for integrating the signal received from said detecting means.

12. A printing machine according to claim 10, wherein said transporting means includes logic circuitry, in communication with said integrating means, for processing signal received from said integrating means and transmitting a control signal to said dispensing means for regulating the discharge of toner particles therefrom into said storing means.

13. A printing machine according to claim 12, wherein said developer roll includes:

a tubular member mounted rotatably for transporting the toner particles closely adjacent to the latent image; and an elongated magnetic member disposed interiorly of and spaced from said tubular member to attract the toner particles thereto.

14. A printing machine according to claim 13, wherein said electrical biasing means includes a voltage source coupled to said tubular member.

15. A method of developing a latent image with marking particles, including the steps of:

storing a supply of marking particles in a housing;

transporting marking particles in the housing on a developer roll to a location closely adjacent to the latent image so that marking particles are attracted to the latent image;

electrically biasing the developer roll;

detecting the current biasing the developer roll and transmitting a signal indicative thereof; and dispensing marking particles into the housing in response to the detected current.

16. A method according to claim 15, further including the step of integrating the signal indicative of the detected current biasing the developer roll and transmitting a signal indicative thereof.

17. A method according to claim 16, further including the step of processing the integrated signal and transmitting a control signal for regulating the dispensing of marking particles into the housing.

18. A method of developing an electrostatic latent image recorded on a photoconductive surface with a developer material comprising at least carrier granules having toner particles adhering triboelectrically thereto, including the steps of:

storing a supply of developer material in a housing;

transporting the developer material in the housing on a developer roll to a location closely adjacent to the latent image so that toner particles are attracted to the latent image;

electrically biasing the developer roll;

detecting the current biasing the developer roll and transmitting a signal indicative thereof; and dispensing toner particles into the housing in response to the detected current.

19. A method of developing according to claim 18, further including the step of integrating the signal indicative of the detected current biasing the developer roll and transmitting a signal indicative thereof.

20. A method of developing according to claim 19, further including the step of processing the integrated signal and transmitting a control signal for regulating the dispensing of toner particles into the housing.

* * * * *